US005738227A

United States Patent [19]

Duff et al.

[11] Patent Number: 5,738,227

[45] Date of Patent: Apr. 14, 1998

[54] DISPLAY RACK FOR FLOOR COVERING

[76] Inventors: James N. Duff, 181 Ragsdill Road, Winnipeg Manitoba, Canada, R2G 4C9; Randy McHolm, 18 Arklie Place, Winnipeg Manitoba, Canada

[21] Appl. No.: 788,999

[22] Filed: Jan. 27, 1997

[51] Int. Cl.[6] ..... A47F 5/00

[52] U.S. Cl. ..... 211/60.1; 211/44; 211/85.5; 211/151

[58] Field of Search ..... 211/44, 151, 60.1, 211/85.5, 79; 312/334.27, 334.29, 334.39, 334.44, 348.6; 248/429, 430

[56] References Cited

U.S. PATENT DOCUMENTS

| | | | |
|---|---|---|---|
| 2,889,907 | 6/1959 | Sullivan | 312/334.39 X |
| 3,402,904 | 9/1968 | Paraskewik | 211/60.1 |
| 3,456,618 | 7/1969 | Barlow | 211/126.15 X |
| 4,155,462 | 5/1979 | Bendel | 211/151 |
| 4,223,792 | 9/1980 | Aspen | 211/60.1 X |
| 5,137,159 | 8/1992 | Collins et al. | 211/151 |

*Primary Examiner*—Robert W. Gibson, Jr.
*Attorney, Agent, or Firm*—Adrian D. Battison; Murray E. Thrift

[57] ABSTRACT

A display rack for floor covering for storing and displaying rolls of floor covering is described. The display rack for floor covering includes a plurality of wheeled tracks extending along the length of the rack. These wheeled tracks are arranged in pairs to support rolling motion of multiple cradles inserted into the display rack for floor covering. The cradles have a substantially concave shape for supporting a roll of floor covering thereon. Once the rolls of floor covering are placed on the cradles, the cradles are then rolled along the wheeled tracks to a storage position. In the storage position, the cradle and the roll of floor covering are located completely within the display rack for floor covering. When the roll of floor covering is to be displayed, the user pulls on the cradle, which then rolls forward along the wheeled track. The cradle is equipped with a stopper to prevent the cradle from being pulled too far forward. To return the cradle to the storage position, the user simply pushes on the cradle, which then rolls along the wheeled track back into the display rack for floor covering.

11 Claims, 3 Drawing Sheets

DISPLAY RACK FOR FLOOR COVERING

The present invention relates to a rack for displaying rolls of floor covering.

BACKGROUND OF THE INVENTION

One common method of displaying floor coverings is a sample book which contains multiple small samples from different rolls of floor covering stored in a book or binder for easy viewing. However, these small samples are often insufficient for customers to imagine how the floor covering will look in their homes. For this reason, customers generally need to look at the roll of floor covering prior to purchase. Unfortunately, there is no standard method for storing and displaying rolls of floor covering. Often, the rolls of floor covering are simply piled one atop the other, making the process of locating the desired roll of floor covering cumbersome and time consuming, as each roll of floor covering in the pile must be examined and then moved before other rolls of floor covering may be examined. Furthermore, the pile of rolls of floor covering is not only unsightly, some of the rolls of floor covering may be inadvertently damaged while being stored in this manner. Finally, rolls of floor covering near the bottom of the pile are not displayed and therefore will not be sold.

SUMMARY OF THE INVENTION

It is one object of the invention, therefore, to provide a rack for storing and displaying rolls of floor covering.

According to a first aspect of the invention, there is provided a display rack for floor covering comprising:

- a structural member comprising a base, a top and four sides;
- a plurality of tracks extending longitudinally across the base and the top of the structural member spaced laterally along the base and the top of the structural member;
- a plurality of cradles, said cradles comprising a support member, said support member having a base, a length, a width and a substantially concave shape for supporting a roll of floor covering thereon; and
- wheeled means arranged for rolling motion of the cradles on the tracks of the structural member, wherein the wheeled means support the cradles for rolling motion thereon such that the cradles slide on the tracks between storage positions wherein the cradles are located within the structural member and display positions wherein the cradles are located at positions partly forward of the top and the base of the structural member, respectively.

Preferably, the tracks are arranged such that there are two tracks for each cradle. The track may comprise a rail comprising a length, a base, a first end, a second end and two braces extending downward from the base of the rail, positioned proximal to the first end and the second end of the rail respectively, said braces for attaching the tracks to the structural member such that the rails are positioned above the top and the base of the structural member. The use of braces to attach the tracks to the rack means that the tracks may be added to an existing rack if desired.

Preferably, the wheeled means comprise a plurality of wheels and the rails of the track include a first side and a top and said wheels are attached to the first side of the rails such that a portion of the wheels are above the top of the rails. The cradles may include stopper means for preventing the cradles from sliding to a position completely forward of the base and the top of the structural member, respectively. The stopper means may comprise a flange attached to the support member of the cradle and protruding downward from the support member of the cradle such that the flange engages the base or the top of the structural member when the cradle is partly forward of the base or the top of the structural member, thereby preventing further forward movement of the cradle. The flange may be composed of foam rubber. Thus, in one embodiment, the cradle is designed to rest upon the wheels of the track. Alternatively, the cradle may be arranged to include wheels rather than the track.

The structural member may include a frontal face, said frontal face being substantially open for unobstructed sliding of the cradles.

The cradles may include handles for gripping the cradles, thereby facilitating sliding the cradles along the tracks. The handles may have a "U" shape and project downward from the support member of the cradles.

Preferably, the structural member has a length of approximately 12 feet, a width of approximately 12 feet and a height of approximately 4 feet and 2 and one half inches.

Thus, in one embodiment, the display rack for floor covering has a two-tiered structure, with a multitude of cradles on each level. If desired, additional levels could be added or the rack itself widened, thereby increasing the number of rolls of floor covering that can be stored and displayed on one rack.

Thus, the above-described invention provides a rack for storing rolls of floor covering so that the rolls of floor covering can be quickly and easily displayed and then returned to storage simply by pulling or pushing a cradle on a wheeled track. Furthermore, the risk of damage to the floor covering from improper storage is greatly reduced.

DETAILED DESCRIPTION

Figure 1:
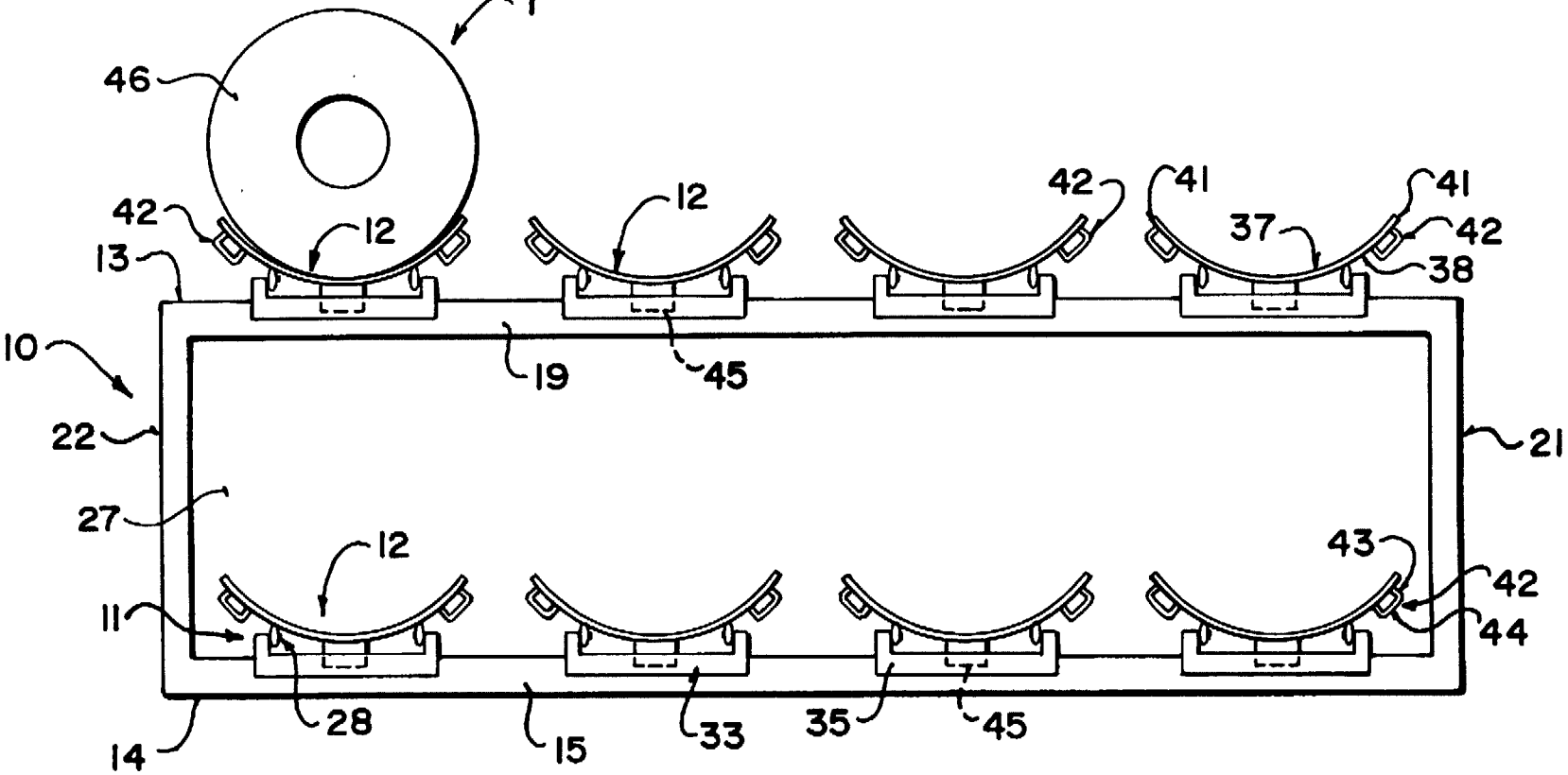
FIG. 1 is a front plan view of the display rack for floor covering.

In one embodiment, the display rack for floor covering 1 comprises a rack 10, tracks 11 and cradles 12. The details of the display rack for floor covering 1 are shown in FIGS. 1 and 2.

The rack 10 comprises a top portion 13 and a bottom portion 14. The bottom portion 14 is comprised of a front member 15, a back member and side members 17. In the preferred embodiment, the front member 15, the back member and the side members 17 of the bottom portion 14 are all approximately 12 feet long. Similarly, the top portion 13 is comprised of a front member 19, a back member and side members 21. In the preferred embodiment, the front member 19, the back member and the side members 21 of the top portion 13 are approximately 12 feet long. The side members 21 and the back member of the top portion 13 and the side members 17 and the back member of the bottom portion 14 respectively are interconnected by beam members 23. The beam members 23 include a top 24 and a bottom 25. In the preferred embodiment, the beam members 23 are approximately 3 feet 10 inches long and connect the top portion 13 and the bottom portion 14 approximately every 4 feet. Thus, in the preferred embodiment, the assembled rack 10 has a length of approximately 12 feet, a width of approximately 12 feet and a height of four feet and 2 and one half inches. Furthermore, the beam members 23 are interconnected by diagonal brace members 26 that extend from a position proximal to the top 24 of one beam member 23 to the bottom 25 of an adjacent beam member 23. The diagonal brace members 26 add structural stability to the rack 10. Of note is that there are no beam members 23 or diagonal brace members 26 interconnecting the front member 19 of the top portion 13 and the front member 15 of the bottom portion 12. Thus, the assembled rack 10 has a front face 27 that is unobstructed.

The tracks 11, the details of which are shown in FIGS. 1 to 4, comprise a rail member 28 having a base 29, a top 30, sides 31 and ends 32. Of note is that the length of the rail members 28 is approximately the same as the length of the side members 17 of the bottom portion and as the length of the side members 21 of the top portion 13 of the rack 10 described above. In the preferred embodiment, the rail members 28 have a length of approximately 12 feet. Furthermore, the rail members 28 include two braces 33 located proximal to the ends 32 of the rail member 28. The braces 33 comprise a horizontal component 34 attached to the base 29 of the rail member 28 and two vertical components 35 extending in a downward direction from the base 29 of the rail member 28. Of note is that the distance between the vertical components 35 of the braces 33 is approximately the same as the width of the front member 15 and the back member of the bottom portion 12 and the front member 19 and the bottom member of the top portion 13 of the rack 10 described above. As described below, the braces 33 are arranged to be fitted over top of the front member 15 and the back member of the bottom portion 12 and over top of the front member 19 and the back member of the top portion 13 of the rack 10 during assembly of the display rack for floor covering 1. Additionally, there are a plurality of wheels 36 bolted to a side 31 of the rail member 28 at regularly spaced intervals, positioned such that a portion of each wheel 36 is above the top 30 of the rail member 28. The exposed portions of the wheels 36 support the cradles 12 as described below.

Figure 2:
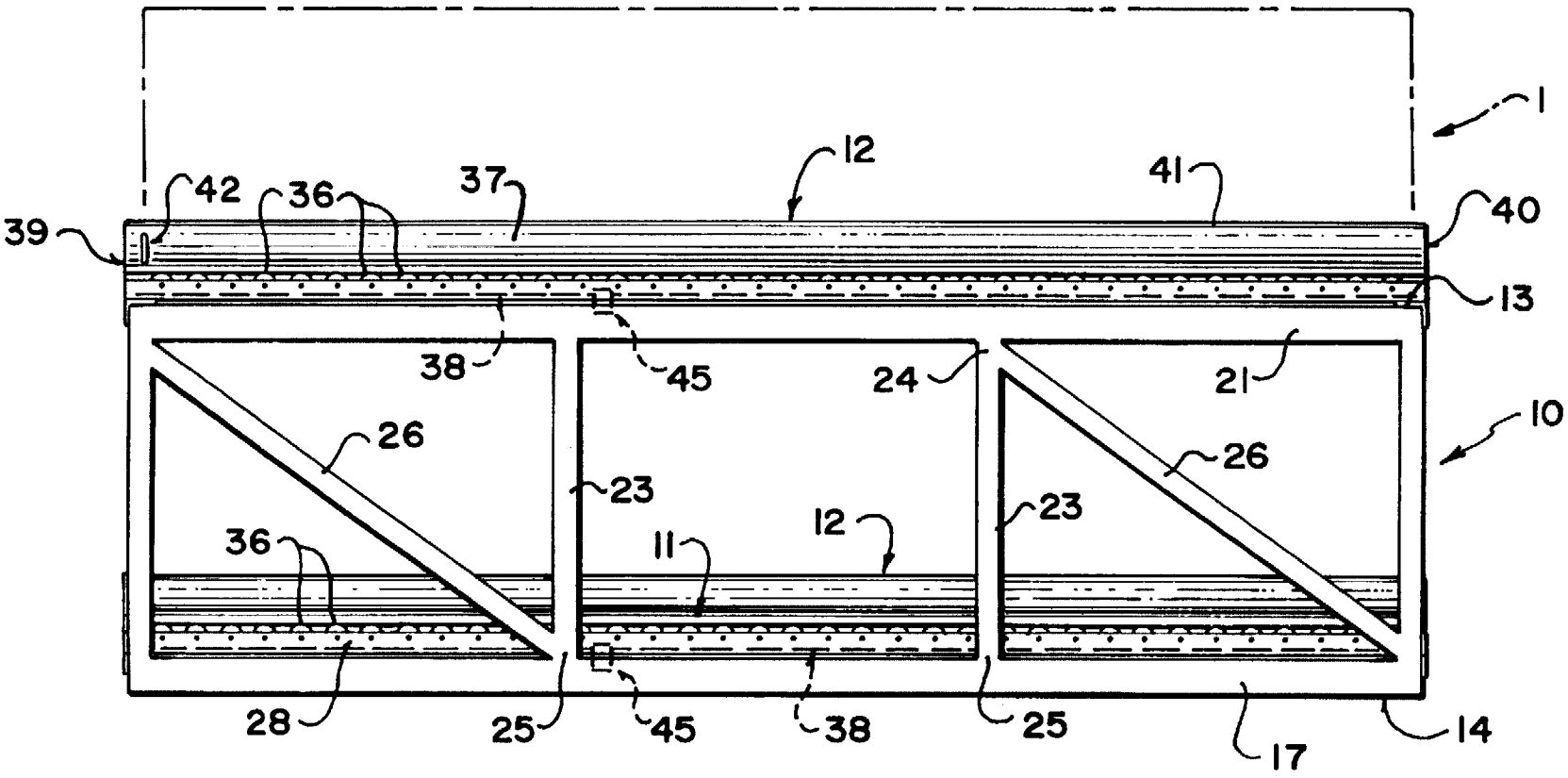
FIG. 2 is a side plan view of the display rack for floor covering.
Figure 3:
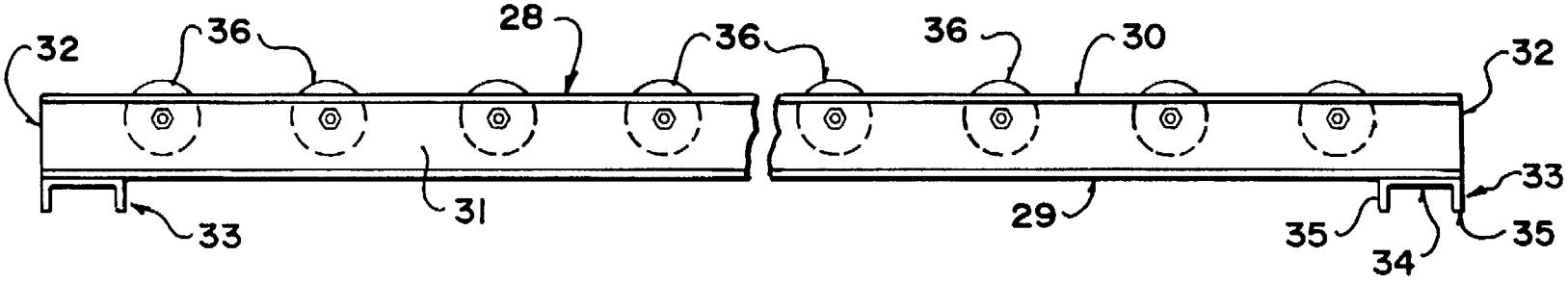
FIG. 3 is a side plan view of the track.
Figure 4:
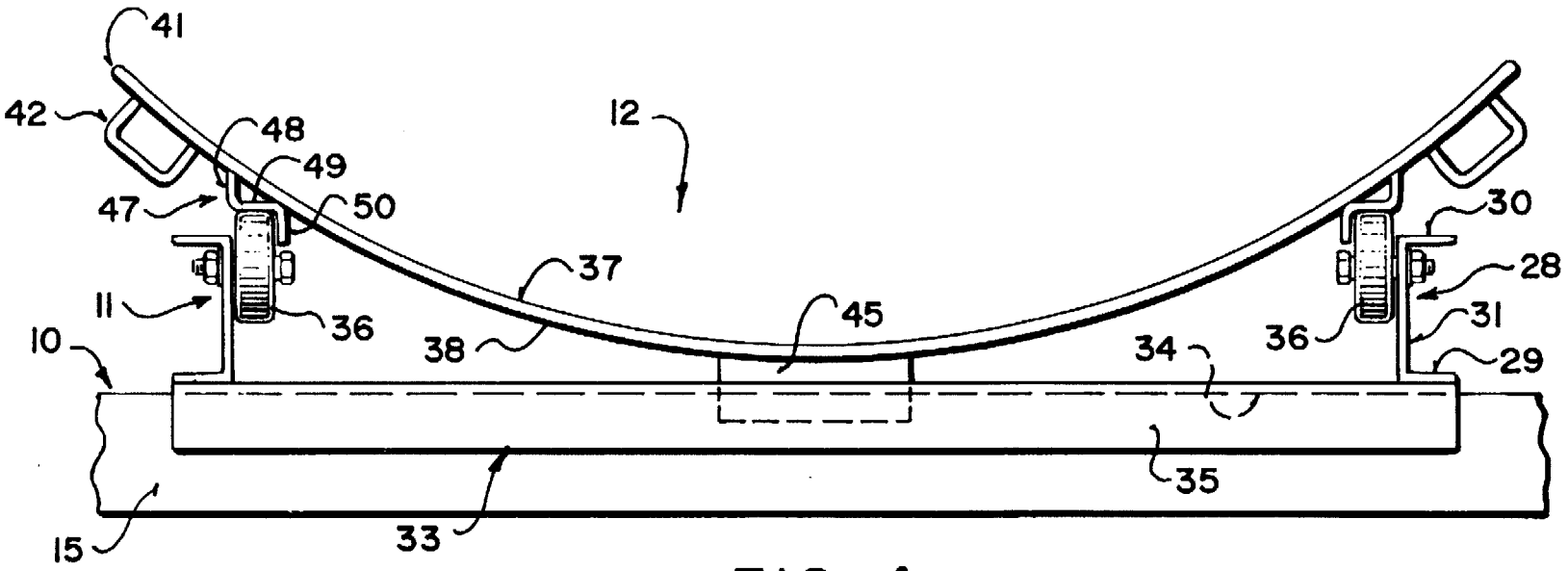
FIG. 4 is a front plan view of the track and the cradle.

The cradles 12, the details of which are shown in FIGS. 1, 2 and 4 comprise a support member 37 having a lower face 38, a front end 39, a back end 40 and sides 41. The support member 37 has a length approximately the same as the length of the side members 17, 18 of the bottom portion and as the length of the side members 21, 22 of the top portion 13 of the rack 10 described above. In the preferred embodiment, the support members 37 have a length of approximately 12 feet. Furthermore, the support member 37 has a substantially concave shape for supporting a roll of floor covering thereon as described below. Each cradle 12 includes two handles 42 located proximal to the front end 39 and proximal to the sides 41 of the support member 37. The handles 42 comprise a horizontal component 44 and two vertical components 43 attached to the lower face 38 of the support member 37. The two vertical components 43 are inter-connected by the horizontal component 44. The handles 42 are designed for gripping contact by a user, as described below. Each cradle 12 also includes brackets 47 bolted to the lower face 38 and extending along the entire length of the cradle 12. The brackets 47 comprise a first vertical component 48, a horizontal component 49 and a second vertical component 50. Finally, the cradles 12 include a flange 45 attached to the lower face 38 of the support member 37 such that the flange 45 extends in a downward direction. The flange 45 is involved in stopping the cradles 12 from being extended too far, as described below. In the preferred embodiment, the flange 45 is composed of foam rubber.

The display rack for floor covering 1 is assembled as follows. First, the rack 10 is assembled by connecting the top portion 13 and the bottom portion 14 with the beam members 23 as described above. As noted above, the front face 27 of the rack 10 is unobstructed. Next, the tracks 11 are fitted into the rack 10 by slipping the braces 33 over the front member 19 and the back member of the top portion 13 and the front member 15 and the back member of the bottom portion 14 respectively. In this configuration, the rail members 28 of the tracks 11 are positioned so as to be above the bottom portion 14 and the top portion 13 of the rack 10. Of note is that the tracks 11 are arranged such that there are two tracks per cradle 12 and the tracks 11 extend across the length of the top portion 13 and the bottom portion 14 of the rack 10 respectively. In the preferred embodiment, the pairs of tracks 11 are separated by 1 foot 8 and five-eighths inches or by a distance that is approximately one half of the width of the cradles 12. Next, the cradles 12 are inserted into the rack 10 from the unobstructed front face 27 of the rack 10. The cradles 12 are inserted into the rack 10 such that the brackets 47 rest on the wheels 36 of the track 11 and the handles 42 are proximal to the front face 27 of the rack 10. Specifically, the horizontal component 49 of the bracket 47 rests upon the wheels 36 and the second vertical component 50 is adjacent to the wheels 36. In the preferred embodiment, one side of the wheels 36 are adjacent to the rail member 28 while the other side of the wheels 36 are adjacent to the second vertical component 50 of the bracket 47, as shown in FIG. 4. In other words, the cradles 12 rest on the wheels 36 of the tracks 11 such that the cradles 12 are capable of rolling motion on the wheels 36. Of note is that the flange 45 is positioned such that as the cradle 12 is moved forward, the flange 45 comes into contact with the front member 19 of the top portion 13 or the front member 15 of the bottom portion 14, thereby preventing the cradles 12 from being extended too far, in other words, to a position where the cradles 12 are no longer in contact with the wheels 36 of the tracks 11.

In operation, rolls of floor covering 46 are placed onto the cradles 12 of the assembled display rack for floor covering 1. At this point, the cradles 12 are in a storage position, wherein the cradles 12 are located within the rack 10. To display the roll of floor covering 46, the user grips the handles 42 of the cradle 12 and pulls forward. As a result, the cradle 12 rolls forward on the wheels 36 of the tracks 11. This forward motion ceases when the flange 45 contacts either the front member 15 of the bottom portion 14 or the front member 19 of the top portion 13, dependent upon the location of the cradle 12 in the display rack for floor covering 1. At this point, the roll of floor covering 46 is in a display position. The roll of floor covering 46 is returned to the storage position by pushing the cradle 12 so that it rolls on the wheels 36 of the tracks 11 back into the display rack for floor covering 1.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A display rack for floor covering comprising:

a structural member comprising a base, a top and four sides;

a plurality of tracks extending longitudinally across the base and the top of the structural member spaced laterally along the base and the top of the structural member;

a plurality of cradles, said cradles comprising a support member, said support member having a base, a length, a width and a substantially concave shape for supporting a roll of floor covering thereon; and wheeled means arranged for rolling motion of the cradles on the tracks of the structural member, wherein the wheeled means support the cradles for rolling motion thereon such that the cradles slide on the tracks between storage positions wherein the cradles are located within the structural member and display positions wherein the cradles are located at positions partly forward of the top and the base of the structural member, respectively.

2. The display rack for floor covering according to claim 1 wherein the tracks are arranged such that there are two tracks for each cradle.

3. The display rack for floor covering according to claim 1 wherein the track comprises a rail comprising a length, a base, a first end, a second end and two braces extending downward from the base of the rail, positioned proximal to the first end and the second end of the rail respectively, said braces for attaching the tracks to the structural member such that the rails are positioned above the top and the base of the structural member.

4. The display rack for floor covering according to claim 1 wherein the wheeled means comprise a plurality of wheels and the rails of the track include a first side and a top and said wheels are attached to the first side of the rails such that a portion of the wheels are above the top of the rails.

5. The display rack for floor covering according to any claim 1 wherein the cradles include stopper means for preventing the cradles from sliding to a position completely forward of the base and the top of the structural member, respectively.

6. The display rack for floor covering according to claim 5 wherein the stopper means comprises a flange attached to the support member of the cradle and protruding downward from the support member of the cradle such that the flange engages the base or the top of the structural member when the cradle is partly forward of the base or the top of the structural member respectively, thereby preventing further forward movement of the cradle.

7. The display rack for floor covering according to claim 6 wherein the flange is composed of foam rubber.

8. The display rack for floor covering according to any claim 1 wherein the structural member includes a frontal face, said frontal face being substantially open for unobstructed sliding of the cradles.

9. The display rack for floor covering according to claim 1 wherein the cradles include handles for gripping the cradles, thereby facilitating sliding the cradles along the tracks.

10. The floor covering rack according to claim 9 wherein the handles have a "U" shape and project downward from the support member of the cradles.

11. The display rack for floor covering according to claim 1 wherein the structural member has a length of approximately 12 feet, a width of approximately 12 feet and a height of approximately 4 feet and 2 and one half inches.

* * * * *